United States Patent [19]

Ichikawa et al.

[11] Patent Number: 4,669,854

[45] Date of Patent: Jun. 2, 1987

[54] ELECTROSTATIC CHARGE-REMOVING DEVICE HAVING FILTER

[75] Inventors: Hideo Ichikawa; Mitsuharu Nakaguchi; Hidekazu Yumoto, all of Kanagawa, Japan

[73] Assignee: Fuji Xerox Co., Ltd., Tokyo, Japan

[21] Appl. No.: 582,650

[22] Filed: Feb. 23, 1984

[30] Foreign Application Priority Data

Feb. 25, 1983 [JP] Japan ..... 58-29547

[51] Int. Cl.[4] ..... G03G 21/00

[52] U.S. Cl. ..... 355/3 R; 355/14 CH

[58] Field of Search ..... 355/3 R, 3 CH, 14 R, 355/14 CH, 15, 71, 8, 52; 350/96.25; 430/58

[56] References Cited

U.S. PATENT DOCUMENTS

| | | | |
|---|---|---|---|
| 3,850,630 | 11/1974 | Regensburger et al. | 430/58 |
| 3,870,516 | 3/1975 | Smith et al. | 430/58 X |
| 3,877,935 | 4/1975 | Regensburger et al. | 430/58 |
| 4,095,888 | 6/1978 | Kawazu et al. | 350/96.25 |
| 4,173,406 | 11/1979 | Oyama et al. | 355/3 R |
| 4,284,344 | 8/1981 | Okamoto et al. | 355/14 CH X |
| 4,333,130 | 6/1982 | Mochizuki et al. | 355/71 X |
| 4,351,603 | 9/1982 | Tagawa | 355/14 CH X |
| 4,400,081 | 8/1983 | Yamashita et al. | 355/14 CH X |
| 4,413,897 | 11/1983 | Kohyama | 355/3 CH |
| 4,457,614 | 7/1984 | Nakajima et al. | 355/15 X |

*Primary Examiner*—Fred L. Braun

*Attorney, Agent, or Firm*—Sughrue, Mion, Zinn, Macpeak, and Seas

[57] ABSTRACT

An electrostatic charge-removing device adapted to remove electrostatic charges formed on a light-sensitive member of a copying machine using a tungsten lamp as an erasing lamp. A filter for cutting off light of longer wavelengths is provided between the tungsten lamp and the light-sensitive member. With this device, the sensitivity of the light-sensitive member is not affected, the amount of output light does not vary with changes in the ambient temperature, and a stable amount of light is obtained over long periods of time. Moreover, the lamp can be started instantaneously without the use of a special circuit.

2 Claims, 2 Drawing Figures

ELECTROSTATIC CHARGE-REMOVING DEVICE HAVING FILTER

BACKGROUND OF THE INVENTION

The present invention relates to an electrostatic charge-removing device adapted to remove electrostatic charges formed on a light-sensitive member, specifically, in an electrophotographic copying machine or electronic printer. More particularly, the present invention is concerned with an electrostatic charge-removing device which employs a tungsten lamp as an erasing lamp.

In a conventional copying machine, such as an electrophotographic copying machine, a light-sensitive member, which is made of a material such as zinc oxide or selenium and shaped in the form of a drum, is charged positively or negatively by the use of a corona charging unit and then exposed to form an electrostatic latent image. The electrostatic latent image is developed by the use of a developing unit using toner particles having the opposite polarity to that of the electrostatic charge on the light-sensitive member. The toner image thus formed is transferred electrostatically to a recording material such as paper by the use of the corona charging unit, and the transferred toner image is fixed to produce a copied document. However, since the toner particles have the opposite polarity to that of the electrostatic charge on the light-sensitive member, they tend to adhere firmly to the light-sensitive member due to electrostatic attraction. Thus the toner image is difficult to transfer to a recording material with a high transfer efficiency. This gives rise to various disadvantages. For example, the image density of the copied image may be low. Also, since it is necessary to remove substantially all toner particles remaining on the light-sensitive member, the surface of the light-sensitive member can be scratched.

In order to overcome the foregoing problems, a procedure such as the following has been employed. As illustrated in FIG. 1, an electrostatic charge-removing device 3 is mounted between a developing unit 1 and a corona charging unit 2 for effecting electrostatic transfer. By removing electrostatic charge on a light-sensitive member 4 by the use of the electrostatic charge-removing device 3 prior to electrostatic transfer of the toner image to the recording material, the electrostatic bonding between the light-sensitive member 4 and the toner particles is released. An erasing lamp, such as a fluorescent lamp, a tungsten lamp, or the like, can be used for the electrostatic charge-removing device. In FIG. 1, reference numerals 12 and 13 indicate, respectively, a paper feeding unit and a corona charging unit for charging the light-sensitive member.

A fluorescent lamp, however, requires a stabilizer and a starter. This arrangement thus has a disadvantage in that the size of the electrostatic charge-removing device is large. Moreover, the use of a fluorescent lamp suffers from disadvantages in that a circuit must be provided to cause the lamp to light instantaneously, the amount of light output varies relatively greatly with changes in ambient temperature, and the service life is short. These disadvantages involved in using a fluorescent lamp can be eliminated by employing a tungsten lamp. In the case of a tungsten lamp, however, the peak of the spectral energy distribution lies in the infrared region. Hence, the use of a tungsten lamp is accompanied by problems such as an increase in the residual potential of the light-sensitive member and a reduction in the sensitivity of the light-sensitive member.

SUMMARY OF THE INVENTION

An object of the invention is thus to provide an electrostatic charge-removing device which is free from the above-described problems of the prior art approaches.

It has been found that if a tungsten lamp is used as an erasing lamp to remove electrostatic charge formed on a light-sensitive member and a filter which cuts off light of longer wavelengths from the tungsten lamp is disposed between the tungsten lamp and the light-sensitive member, a reduction in the sensitivity of the light-sensitive member is prevented. Also, no significant change in the amount of light is caused by a change in the ambient temperature, and a constant light output is obtained. Moreover, the tungsten lamp can be started instantaneously without the use of a special circuit.

Accordingly, the present invention provides an electrostatic charge-removing device using a tungsten lamp as an erasing lamp to remove electrostatic charges on a light-sensitive member of a copying machine, characterized in that a filter to cut off light of longer wavelengths from the tungsten lamp is disposed between the tungsten lamp and the light-sensitive member.

DESCRIPTION OF THE PREFERRED EMBODIMENTS

The present invention will now be described in more detail in conjunction with the accompanying drawings.

Figure 1:
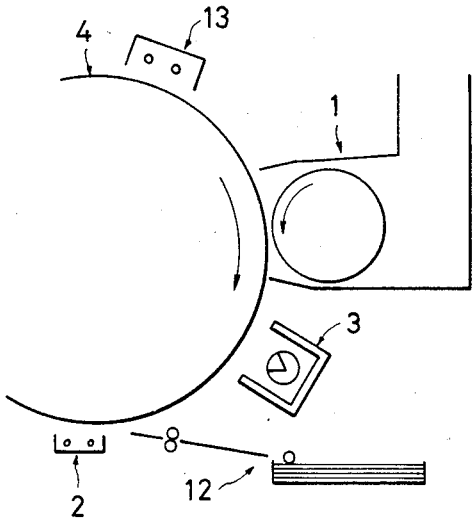
FIG. 1 PRIOR ART
FIG. 1 is a schematic diagram illustrating a conventional electrostatic charge-removing device.
Figure 2:
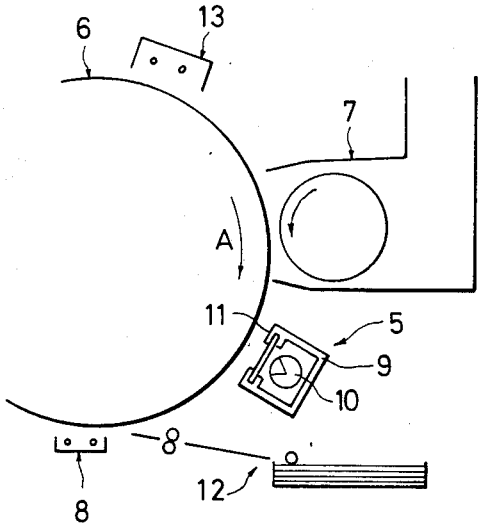
FIG. 2 is a schematic diagram illustrating an example of a electrostatic charge-removing device of the invention.

As shown in FIG. 2, an electrostatic charge-removing device 5 of the invention is placed between a developing unit 7, provided at the periphery of a drum-shaped light-sensitive member 6 rotating in the direction indicated by arrow A, and a corona charging unit 8 for causing electrostatic transfer. The electrostatic charge-removing device 5 includes a housing 9, a tungsten lamp 10 mounted in the interior of the housing 9, and a filter 11 covering the front surface of the housing 9 which is adapted to cut off light of longer wavelengths from the tungsten lamp 10. For the filter 11, any filter can be used as long as it is capable of cutting off light of longer wavelengths, for instance, longer than about 600 nm. A blue glass plate produced by Sano Kiko Co., Ltd. of Japan is acceptable for this purpose.

When the surface of the light-sensitive member 6 on which electrostatic latent image has been developed by means of the developing unit 7 is illuminated by the tungsten lamp 10 in the electrostatic charge-removing device 5, passes through the toner layer, removing electrostatic charge on the light-sensitive member 6 and thereby releasing the electrostatic bonding between the light-sensitive member 6 and the toner. Moreover, since the filter 11 cuts off light of longer wavelengths from the tungsten lamp 10, no increase in the residual potential of the light-sensitive member 6 and no reduction in the sensitivity of the light-sensitive member 6 are produced. Toner particles which have been released from electrostatic bonding are efficiently transferred to the recording material by means of the corona charging unit 8.

Although the electrostatic charge-removing device of the invention is provided between the developing unit and the corona charging unit in the embodiment of FIG. 2, it may be provided in front of the corona charging unit for the charging of the light-sensitive member for the purpose of removing the residual potential of the light-sensitive member which affects the reduction in the sensitivity of the light-sensitive member.

Despite the fact that a tungsten lamp is used as an erasing lamp to remove electrostatic charge, the electrostatic charge-removing device of the invention has various advantages over the conventional devices. For example, the sensitivity of the light-sensitive member is not reduced, the amount of light output does not vary with changes in ambient temperature, and a stable light output is obtained over long periods of time. Moreover, the lamp can be started instantaneously without the use of a special circuit. Hence the present invention is of high practical value.

We claim:

1. In an electrostatic charge-removing device using a tungsten lamp as an erasing lamp for removing electrostatic charge formed on a light-sensitive member of a copying machine, the improvement comprising; a filter for cutting off light from said lamp having a wavelength above 600 nm disposed between said tungsten lamp and said light-sensitive member, wherein said light above 600 nm increases the residual potential of said light sensitive member; and said charge-removing device is disposed between a developing unit and a corona charging unit of said copying device.

2. The electrostatic charge-removing device of claim 1, wherein said charge-removing device is disposed in front of a corona charging unit of said copying machine.

* * * * *